219-121 SR
7/16/85 XR 4,529,958

United States Patent [19]

Person et al.

[11] Patent Number: 4,529,958

[45] Date of Patent: Jul. 16, 1985

[54] ELECTRICAL RESISTOR

[75] Inventors: Herman R. Person; Douglas E. Johnson, both of Columbus, Nebr.

[73] Assignee: Dale Electronics, Inc., Columbus, Nebr.

[21] Appl. No.: 621,619

[22] Filed: Jun. 18, 1984

Related U.S. Application Data

[63] Continuation-in-part of Ser. No. 490,853, May 2, 1983, Pat. No. 4,467,311.

[51] Int. Cl.[3] ..... H01C 1/034; H01C 3/12

[52] U.S. Cl. ..... 338/275; 219/121 LM; 219/541; 219/544; 219/552; 338/195; 338/217; 338/276; 338/280; 338/283; 338/293

[58] Field of Search ..... 338/176, 195, 217, 218, 338/254, 255, 275, 276, 279, 280, 281, 282, 283, 284, 287, 293, 294, 329; 219/121 LM, 530, 531, 541, 544, 552, 553; 29/620, 621; 318/568

[56] References Cited

U.S. PATENT DOCUMENTS

| | | | |
|---|---|---|---|
| Re. 28,597 | 10/1975 | Horii et al. | 338/275 |
| 918,535 | 6/1908 | Hadaway, Jr. | 338/280 |
| 1,088,003 | 2/1914 | Wilkinson | 338/281 X |
| 1,975,410 | 10/1934 | Simpson | 338/217 X |
| 2,457,616 | 12/1948 | Van Dyke et al. | 338/283 X |
| 2,600,486 | 6/1952 | Cox | 338/293 X |
| 2,622,178 | 12/1952 | Glynn | 338/217 |
| 3,293,587 | 12/1966 | Robinson | 338/300 |
| 3,530,573 | 9/1970 | Helgeland | 219/121 LM X |
| 3,534,472 | 10/1970 | de Jong | 29/620 |
| 3,601,744 | 8/1971 | Zandman | 338/183 |
| 4,032,743 | 6/1977 | Erbach et al. | 219/121 LM |
| 4,075,452 | 2/1978 | Simon | 219/121 LM |
| 4,149,064 | 4/1979 | Houska et al. | 219/121 LM |
| 4,172,249 | 10/1979 | Szwarc | 338/195 |
| 4,193,021 | 3/1980 | Gale et al. | 318/568 |
| 4,297,670 | 10/1981 | Solow | 338/275 X |
| 4,306,217 | 12/1981 | Solow | 338/275 |
| 4,325,183 | 4/1982 | Khambalta | 29/621 |
| 4,333,069 | 6/1982 | Worth et al. | 338/315 |
| 4,345,235 | 8/1982 | Riley et al. | 338/176 |

FOREIGN PATENT DOCUMENTS

| | | | |
|---|---|---|---|
| 732710 | 6/1955 | Canada | 338/280 |
| 80028 | 10/1955 | Denmark | 338/275 |

*Primary Examiner*—Volodymyr Y. Mayewsky
*Attorney, Agent, or Firm*—Zarley, McKee, Thomte, Voorhees & Sease

[57] ABSTRACT

The electrical resistor of the present invention comprises a flat metal plate having a thickness from 1 mil to 50 mils. A pair of electrical leads are operatively attached to the ends of the metal plate, and the side edges of the metal plate are provided with a plurality of notches extending inwardly in spaced apart relation to one another, with slots of one of the sides of the plate being staggered with respect to the slots of the other side of the plate. Each of the slots extend completely through the thickness of the plate and are formed by a laser beam cut which anneals the metal of the plate and imparts stability to the electrical characteristics of the metal plate. Once formed, the metal plate may be bent into different shapes to achieve the desired geometric configuration. Furthermore, the plate can be embedded in molded material so as to provide a protective covering for the plate.

8 Claims, 18 Drawing Figures

ELECTRICAL RESISTOR

BACKGROUND OF THE INVENTION

This application is a continuation-in-part of co-pending application Ser. No. 490,853, filed May 2, 1983, now U.S. Pat. No. 4,467,311.

The present invention relates to high power, low resistance value resistors.

Normally such resistors are wire wound resistors which are made by winding a fine wire made from some resistance material around a ceramic cylinder with the ends of the wire welded to caps which are swaged to each end of the cylinder. Copper leads are normally welded to the caps and extend axially therefrom. Usually such wire wound resistors are then coated with some form of insulating material to protect the reaistance wire.

The foregoing method of manufacturing a wire wound resistor requires numerous parts and is very labor intensive. The number of parts in such resistors is usually six (two end caps, two leads, one ceramic core, and one resistance wire). In addition to this, a coating of some sort must be provided.

Therefore, a primary object of the present invention is the provision of an improved power resistor which has high stability, relatively low resistance value, and a low temperature coefficient.

A further object of the present invention is the provision of a resistor which can be manufactured with a reduction in the amount of labor required.

A further object of the present invention is the provision of a resistor which has a reduced number of parts therein.

A further object of the present invention is the provision of a resistor which enables the production equipment to be fully automated and completely computer controlled.

A further object of the present invention is the provision of a process for making a resistor, which can utilize an in-line continuous process for manufacture.

A further object of the present invention is the provision of a resistor which can be manufactured at a greatly reduced cost.

A further object of the present invention is the provision of a resistor which can be automatically trimmed to very close tolerances with no additional labor costs.

A further object of the present invention is the provision of a resistor which is manufactured by a versatile production process so that a single type of material and production set-up can be used to make resistors with widely varying resistance value ranges.

A further object of the present invention is the provision of a process which automatically and naturally anneals and stabilizes the electrical characteristics of the resistors.

A further object of the present invention is the provision of a device which is economical to manufacture, durable and stable in use, and efficient in operation.

SUMMARY OF THE INVENTION

The present invention utilizes a rectangularly shaped flat plate, having opposite ends and opposite side edges. The plate is preferably metal such as a nickel aluminum alloy, and it is preferably of a thickness from 1 to 50 mils. Electrical leads are spot welded or otherwise attached to the opposite ends of the rectangular plate. Then a laser beam is used to cut a plurality of notches or slots in the side edges of the metal plate. The laser beam cuts completely through the metal plate and the notches are arranged in staggered relationship to one another so as to increase the effective length that a current will have to pass in order to pass from one end of the plate to another.

The process of cutting the resistance material with a laser beam automatically and naturally anneals the resistance material so that the electrical characteristics of the resistor are stable after the part is completely made. Other methods of cutting the resistance material such as sawing, abrading, etc., introduce stresses into the resistance material which later cause the resistance and the stability of the resistor to change with time. The present invention which utilizes the laser beam to cut the slots automatically results in the resistor having substantial stability over extended periods of usage. It is believed that this results from the fact that the laser beam provides a smooth, straight cut, and that the laser beam also anneals the metal during the cutting process.

Laser beams have been previously used to cut and trim what are referred to in the art as thick film resistors. These resistors include a substrate having a metal film imprinted thereon. The thickness of the metal film is usually less than one mil. These film resistors are of a different type than the high powered, low resistance value resistors commonly manufactured by the wire wound process.

Heretofore, the high powered resistors have conventionally been made by the wire wound technique, because of the difficulty in providing stability to a slotted metal plate having a thickness such as the thickness required for high powered resistors. Normally, this thickness ranges from 1 mil to 50 mils. The present invention, however, is possible because of two results not heretofore recognized, i.e., that the laser beam provides a smooth cut to the groove and further, because the laser beam anneals the metal during the cutting process. As a result, the resistors made by the present invention are stable throughout extended periods of use.

DETAILED DESCRIPTION OF THE PREFERRED EMBODIMENT

Figure 3:
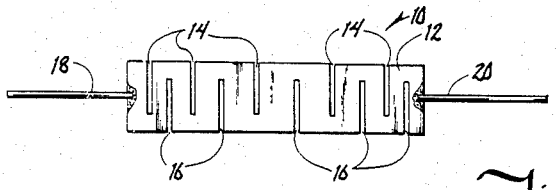
FIG. 3 is a plan view of a resistance element which has been cut by the present invention.

Referring to the drawings, particularly FIG. 3, the numeral 10 generally designates the electrical resistor of the present invention. Resistor 10 is comprised of a metal plate 12 having a plurality of grooves 14 extending inwardly from one edge thereof and a plurality of grooves 16 extending inwardly from the opposite edge thereof.

A pair of leads 18, 20 are connected to the opposite ends of plate 12 by spot welding or by any other convenient process for electrically connecting the leads to the plate.

Plate 12 may be comprised of any conductive material, and the preferred material is a nickel chromium alloy. The thickness of the metal alloy can be in the range of 1 mil to 50 mils, and the preferred range is from 8 to 50 mils.

The notches 14 and 16 are staggered and alternating with one another. Furthermore, notches 14 16 extend inwardly so that they are in overlapping relationship with one another. This effectively increases the path which electrical current must follow traveling from lead 18 to lead 20. The resistance of the device can be varied by increasing the depth of cut of the grooves 14 and 16 and also by changing the distances between grooves 14 and 16. Changing the number of grooves 14, 16 will also vary the resistance. The resistance is increased by increasing the number of grooves.

As can be seen in FIG. 3, the slots 14, 16 adjacent the ends of the plate 12 are closer together than the slots 14, 16 are adjacent the longitudinal midpoint of plate 12. This causes the resistance to be greater at the opposite ends of the plate. The reason for this is that with power resistors, a hot spot is normally encountered adjacent the longitudinal center of the resistor. The reason for the hot spot in such conventional wire wound resistors is that the heat can be dissipated more easily from the ends of the resistor than it can from the longitudinal center of the resistor.

By placing the slots 14 and 16 closer together adjacent the ends of the resistor, it is possible to permit them to dissipate a greater amount of heat adjacent the ends of the resistor while at the same time keeping the temperature of the resistor relatively constant across the entire length thereof. Thus, the tendency to form a hot spot adjacent the center of the resistor is minimized by the relative spacing of the grooves as shown in FIG. 3.

Figure 1:
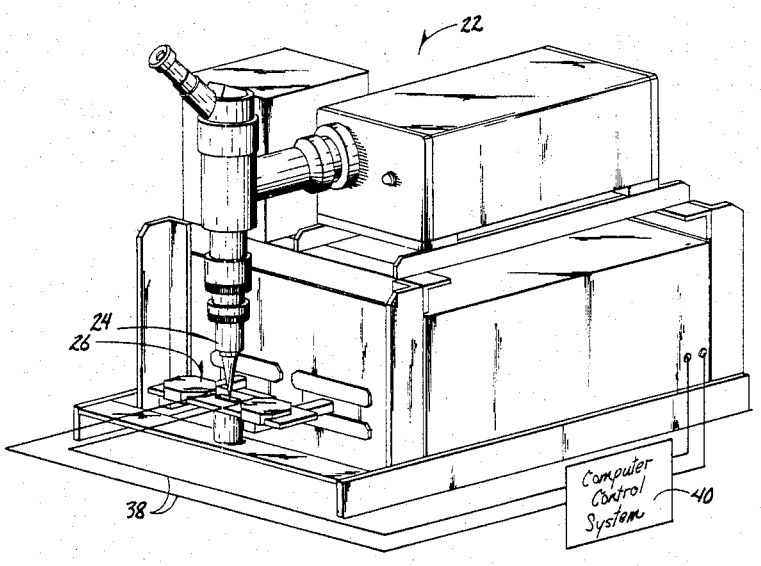
FIG. 1 is a perspective view of the machine for producing the resistance element of the present invention.
Figure 2:
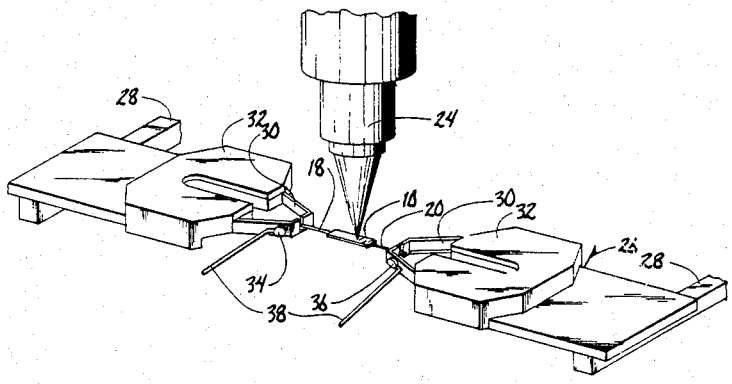
FIG. 2 is a partial perspective view showing the laser cutting tool in place over a resistance element to be cut.

Referring to FIGS. 1 and 2, a laser cutting machine 22 is shown for forming the resistor of the present invention. Machine 22 is conventional in construction and is typical of laser cutting machines which are commercially available for the purpose of cutting and drilling steel. Typical of such industrial laser cutting machines is a machine manufactured by Ratheon Company, at its Laser Center at 4th Ave., Burlington, Mass., 01803 under the trade designation SS-501-3. This machine is a laser welding system capable of 400 watts average power at up to 200 pulses per second. The maximum energy per pulse is 25 joules. The pulse width variable is from $\frac{1}{8}$ m/s to 3 m/s.

Machine 22 includes a laser head 24 for directing a laser beam at the object to be cut.

FIG. 2 shows the support table 26 of the machine which is used to move the work piece relative to the laser head 24. Support table 26 is capable of moving in a first direction by means of longitudinal sliding of slides 28. Movement of the work piece in a direction transverse to this first direction is caused by virtue of slide blocks or test clips 30 which are slidably fitted within channels 32. Thus, slides 28 and slide blocks 30 provide an XY axis upon which the work piece can be moved.

The first step in the manufacturing process involves attaching the leads 18, 20 to the plate 12. Once these are attached, the plate and the leads are secured in test clips 30 in the fashion shown in FIG. 2. Attached to the leads are a pair of electrical connectors 34, 36 which are attached to wires 38. Wires 38 lead to a computer control system 40 which is shown in block diagram in FIG. 1. Such computer control systems are known in the art as is exemplified by U.S. Pat. No. 4,345,235 dated Aug. 17, 1982. The computer control system 40 senses the electrical resistance value between the two leads 18 and 20. The computer control system 40 is then capable of determining the distances between and the depths required for grooves 14 and 16 in order to achieve the desired electrical resistance value for the completed resistor. Once this is calculated by the computer control system, it directs the machine 22 to cut the grooves in accordance with the calculated pattern. The computer control system continues to monitor the resistance of the device throughout the cutting process so that precision can be obtained in the ultimate resistance value of the device.

The laser beam systematically cuts the various notches 14 and 16 in the plate by forming a groove which extends completely through the thickness of plate 12 and which extends inwardly in overrlapping and staggered relationship with the grooves formed on the opposite side thereof.

The slots are cut perpendicular to the longitudinal axis of the resistor so that the elecrical length of the current path is lengthened, thereby increasing the effective resistance of the device.

The procedure for cutting the resistance to the desired value includes the following steps:

(a) The resistor is placed in position on the XY table by automatic parts handling equipment (not shown).

(b) The initial resistance of the resistor is read.

(c) This initial resistance is fed to the computer system 40 where it is compared to the resistance value that is previously programmed into computer 40 and which represents the desired resistance value.

(d) The computer then calculates the required number of slots, the depth of the slots, and the spacings of the slots so as to provide the ultimate desired resistance. For a low value of resistance, there would be relatively few cuts of very short length, whereas for a high value of resistance, there would be many cuts of greater length.

(e) The XY table 26 then begins to move the part under the laser beam so that the laser beam can cut the slots as desired. This would be done at as fast a possible rate until the very last slot is being cut. At that time, the speed of the cutting operation would be reduced so that the resistance of the resistor could be determined to a fine tolerance. The resistance tolerances of less than one-half percent are easily obtainable with this method.

(f) The resistance value of the resistor is monitored constantly during the cutting process, and at the end when the resistor reaches its proper value in tolerance, the resistor is placed in additional automatic handling equipment (not shown) and moved along in the production line.

The mounting of leads 18, 20 is shown to be done by a spot welding process, but other processes such as butt welding could be utilized.

Furthermore, after the resistor is complete, it is potted, coated or molded into a protective coating in conventional fashion.

One particular advantage which has been found to result from the use of laser beams to cut the grooves 14, 16 is that the laser beam at the same time that it is cutting the groove, also anneals the metal, thereby causing the metal to maintain a stable electrical characteristic. In the absence of this annealing process, the resistor tends to be unstable over extended use, and the resistance value of the resistor will change throughout use. This is particularly true if the grooves 14, 16 are provided by some mechanical means such as cutting, sawing or other means. Such mechanical means for producing the resistor have been found to produce highly unstable resistors which do not maintain a constant resistant value throughout use. The laser beam presumably because of its smooth cutting action, and because of its simultaneous annealing of the metal, has been found to provide a surprisingly improved stability over that obtained by other means.

Figure 4:
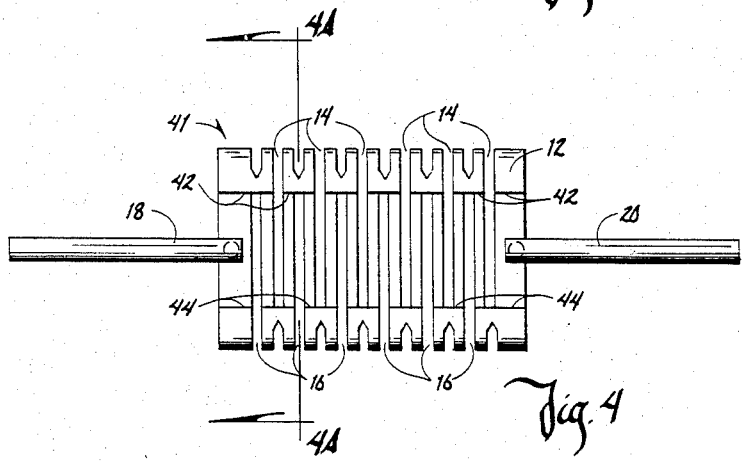
FIG. 4 is a top plan view of a modified form of the present invention.
Figure 4A:
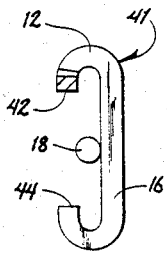
FIG. 4A is a sectional view taken along line 4A—4A of FIG. 4.

Referring to FIG. 4, a modified form of the invention is shown and is designated by the numeral 40. Resistor 40 includes leads 18, 20 similar to the leads 18, 20 shown in the device 10 of FIG. 3. Similarly, a metal plate 12 is utilized and is provided with a plurality of grooves 14, 16, extending inwardly from the opposite edges thereof. However, plate 12 is bent into a C-shaped configuration as is demonstrated by the cross-sectional view of FIG. 4A. The side edges 42, 44 are bent inwardly to form the C-shape cross-sectional configuration, thereby reducing the geometric size of the resistor so that it will fit into a confined area within the circuitry.

Figure 5:
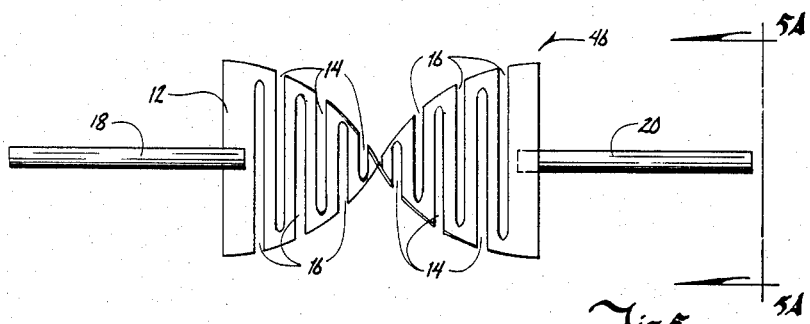
FIG. 5 is a plan view of a modified form of the present invention.
Figure 5A:
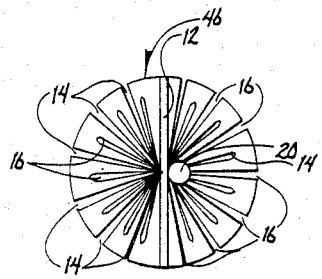
FIG. 5A is a sectional view taken along line 5A—5A of FIG. 5.

Another modified form of the invention is shown in FIG. 5 and is designated by the numeral 46. Resistor 46 includes the same components described for the previous modifications including leads 18, 20, plate 12, and slots or grooves 14, 16. However, after plate 12 has been provided with grooves 14, 16, it is twisted approximately 180° so as to give the plate 12 a helical or screw-like configuration.

Figure 6:
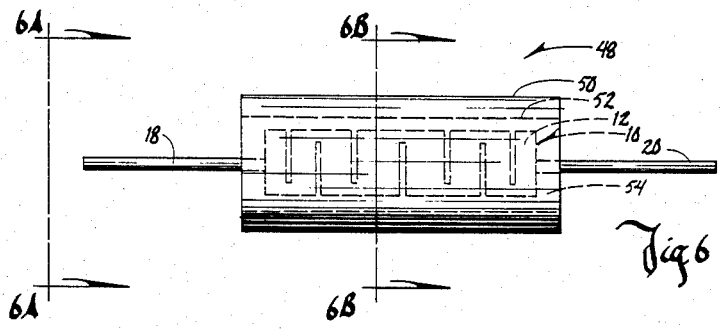
FIG. 6 is a plan view of a modified form of the present invention.
Figure 6A:
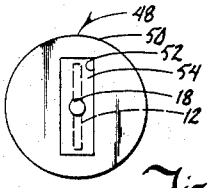
FIGS. 6A and 6B are sectional views taken along lines 6A—6A and 6B—6B of FIG. 6.
Figure 6B:
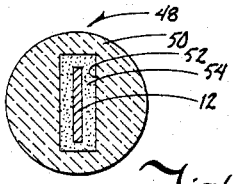

Another form of the invention is shown in FIG. 6, and is designated by the numeral 48. Resistor 48 includes a cylindrical ceramic or molded plastic housing 50 which includes a longitudinal bore 52 extending axially therethrough. Bore 52 is shown to be rectangular in cross-section, but it is also possible that bore 52 could have other cross-sectional shapes such as ovular or circular. Resistor 10 (FIG. 3) is placed within bore 52 so that it does not touch housing 50. Then a molding compound such as commonly used for housed resistors, is placed within the bore so that it completely surrounds plate 12 of resistor 10 and protects plate 12 of resistor 10 from outside influence. The molding compound is designated by the numeral 54. The two preferred molding compounds for use in this process are manufactured by Dow Corning Company, 592 Saginaw Ro., Midland, Mich., and are designated as Dow Corning Silicon Molding Compounds under the product numbers 1-5201 and 480.

Figure 7:
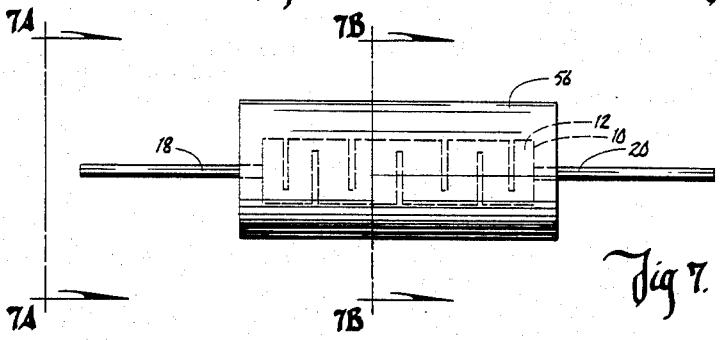
FIG. 7 is a plan view of a modified form of the present invention.
Figure 7A:
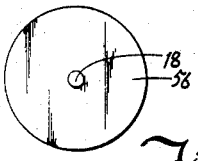
FIGS. 7A and 7B are sectional views taken along lines 7A—7A and 7B—7B of FIG. 7.
Figure 7B:
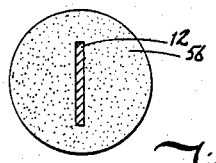
Figure 8:
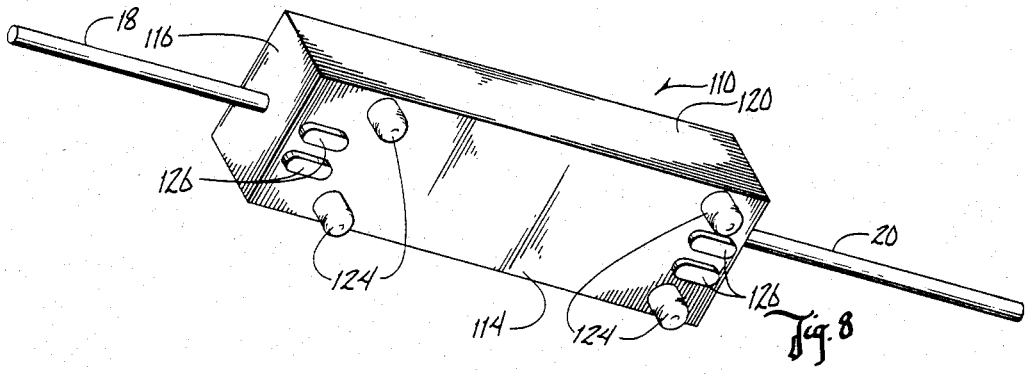
FIG. 8 is a perspective view of a modified form of the resistor.
Figure 9:
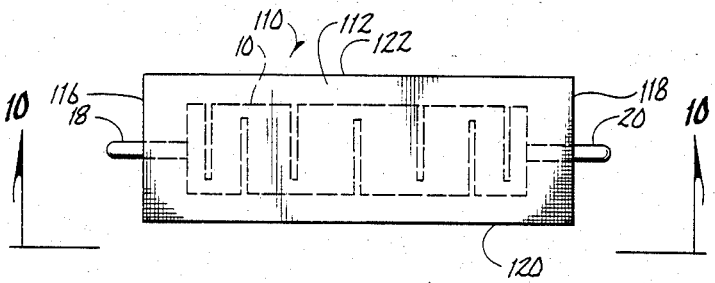
FIG. 9 is a top plan view of the resistor of FIG. 8.

Referring to FIG. 7, another form of the invention is shown for molding resistor 10. The molding compound designated by the numeral 56 is formed around plate 12 of resistor 10 so that it completely surrounds plate 12 but permits leads 18, 20 to protrude outwardly from the ends thereof. This molded resistor is designated by the numeral 58.

Referring to FIGS. 8–12, a modified form of the invention is shown and is generally designated by the numeral 110. Device 110 utilizes resistor 10 which has been formed by the laser process described above. Resistance element 10 is embedded within a hardenable plastic insulative material, and this material is formed into a generally rectangular shape having a top surface 112, a bottom surface 114, opposite end surfaces 116, 118 and opposite side surfaces 120, 122. The resistance element 10 is completely embedded within the plastic material and only the leads 18, 20 of resistance element 10 protrude outwardly from the rectangular block of insulative material.

The undersurface 114 of device 110 has formed therein four feet 124 and two pairs of lead guides 126.

Figure 10:
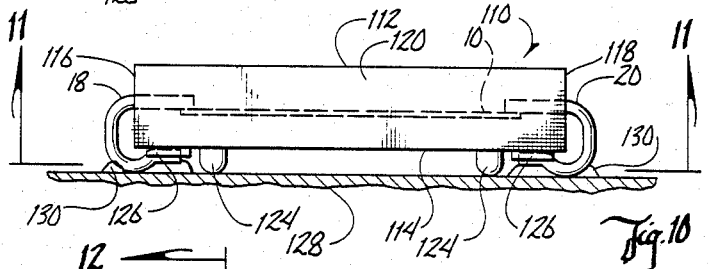
FIG. 10 is a view taken along line 10—10 of FIG. 9.
Figure 11:
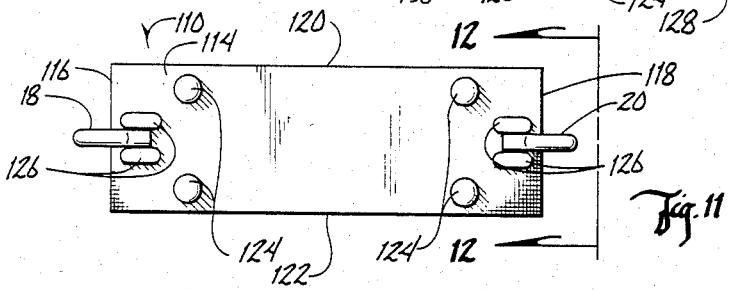
FIG. 11 is a view taken along line 11—11 of FIG. 10.
Figure 12:
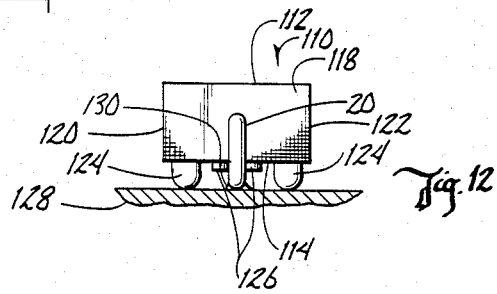
FIG. 12 is a view taken along lines 12—12 of FIG. 11.

Device 110 is adapted to be mounted on the surface of a circuit board 128. To facilitate mounting device 110 on circuit board 128, leads 18, 20 will be formed as shown in FIG. 10. They are then soldered to the circuit board by a solder joint 130. Feet 124 support the device 110 in spaced relation above the circuit board so that the device does not interfere with other circuitry which might be on the board. This arrangement also allows the heat from the part to escape more easily, and facilitates the cleaning of the solder joints. The four feet also hold the part in place and level before and during the soldering operations. Lead guides 126 help hold the ends of the leads 18, 20 against movement so that they are not moved during handling and soldering.

This ability to form the terminals readily facilitates mounting the resistor on a circuit board without the need to trim the terminals after soldering. It also eliminates the need to drill holes in the circuit board.

The present invention provides a significant improvement over previous wire wound resistors. The resistor of the present invention contains only three parts, whereas the number of parts in a wire wound resistor is six, without counting the coating material. The production equipment necessary to produce this newly improved resistor can be fully automated and completely computer controlled. The resistance material to make the part can be purchased in long, continuous rolls, which can be automatically fed into the equipment along with copper wire for the leads. The automatic equipment can then completely make the part without having any requirement of workers touching the resistor again. The cost of manufacturing the resistor is significantly reduced from the manufacturing process presently used for standard wire wound resistors.

When the part is automatically cut with the laser, as in the present invention, the resistance measuring device is constantly measuring the resistor and this allows the resistor to be trimmed to very close tolerances. The new resistor is versatile in that it can be made to many different resistor values by using only one type and size of resistance material, and one production set-up. The computer can automatically compute the required number of slots and depths of slots so as to make the resistor to the tolerance and resistance value required.

The process of cutting the resistance material with a laser beam automatically and naturally anneals the resistance material so that the electrical characteristics of the resistor are substantially stable after the part is completely made. Other methods of cutting the resistance materials such as sawing, abrading, etc. introduces stresses into the resistance material which later cause the resistance and the stability of the resistor to change with time. The present process automatically assures that the resistor is stable throughout extended periods of use.

Thus, it can be seen that the device accomplishes at least all of its stated objectives.

What is claimed is:

1. A high power, low resistance electrical resistor comprising:

a flat metal plate having a thickness of from 1 mil to 50 mils and having opposite lateral edges and opposite ends;

a pair of electrical leads operatively attached to said flat metal plate at said opposite ends thereof;

said metal plate having a plurality of notches extending inwardly from said opposite lateral edges thereof in spaced apart relationship to one another with said notches of one of said opposite sides being staggered with respect to said notches of the other of said opposite sides, each of said notches extending completely through the thickness of said plate and being formed by a laser beam cut so as to anneal the metal of said plate and impart stability to the electrical characteristics of said metal plate;

a hardened compound of electrically insulating material surrounding and completely embedding said plate to form a body of predetermined shape, said leads protruding outwardly from said body, said molding compound providing structural support for said metal plate to minimize bending or breaking thereof.

2. An electrical resistor according to claim 1 wherein said body is shaped into a cylinder with said leads protruding axially outwardly from the opposite ends of said cylinder.

3. An electrical resistor according to claim 1 and further comprising a dielectric sleeve having a cylindrical outer surface and a longitudinal bore extending axially therethrough, said plate being positioned within said bore with said leads extending outwardly beyond the opposite ends of said bore, said molding compound surrounding said plate and filling said bore so as to hold said plate within said bore.

4. An electrical resistor according to claim 1 wherein said body is in the shape of a rectangular block having a top surface, a bottom surface, two opposite side surfaces, and two opposite end surfaces, said leads protruding outwardly from said opposite end surfaces.

5. An electrical resistor according to claim 4 wherein a plurality of supporting feet are formed on said bottom surface for supporting said body on a supporting surface with said bottom surface spaced above said supporting surface.

6. An electrical resistor according to claim 5 wherein two pairs of lead guides are formed on said bottom surface adjacent the opposite ends thereof, each of said pairs of lead guides comprising two spaced apart guide members, the space between said guide members corresponding approximately to the diameter of said leads, whereby said leads may be bent and folded against said bottom surface and will fit in nesting relation between said spaced part lead guides when so folded.

7. A high power, low resistance electrical resistor made by the process comprising:

attaching a pair of electrical leads to the opposite ends of a flat metal plate having a thickness of from 1 mil to 50 mils and having opposite lateral edges extending between said opposite ends;

using a laser beam to cut completely through the thickness of said plate so as to form staggered and inwardly extending notches in said side edges of said plate to increase the effective electrical resistance of said plate, said laser beam at the same time annealing said metal of said metal plate so that the electrical characteristics of said metal plate are stable after said notches have been cut, said plate being free from substrate support during the time that said laser beam is cutting said plate;

placing a hardened compound of electrically insulative material around said plate after cutting said plate with said laser beam so as to completely embed said plate within said compound to form a body of predetermined shape.

8. A high power, low resistance electrical resistor comprising:

a flat metal plate having a thickness of from 8 mils to 50 mils and having opposite lateral edges and opposite ends;

a pair of electrical leads operatively attached to said flat metal plate at said opposite ends thereof;

said metal plate having a plurality of notches extending inwardly from said opposite lateral edges thereof in spaced apart relationship to one another with said notches of one of said opposite sides being staggered with respect to said notches of the other of said opposite sides, each of said notches extending completely through the thickness of said plate and being formed by a laser beam cut so as to anneal the metal of said plate and impart stability to the electrical characteristics of said metal plate;

a hardened compound of electrically insulating material surrounding and completely embedding said plate to form a body of predetermined shape, said leads protruding outwardly from said body, said molding compound providing structural support for said metal plate to minimize bending or breaking thereof.

* * * * *